United States Patent [19]

Hellawell

[11] Patent Number: 4,462,454

[45] Date of Patent: Jul. 31, 1984

[54] METHOD FOR REDUCING MACROSEGREGATION IN ALLOYS

[75] Inventor: Angus Hellawell, Hancock, Mich.

[73] Assignee: Michigan Technological University, Houghton, Mich.

[21] Appl. No.: 320,597

[22] Filed: Nov. 12, 1981

[51] Int. Cl.[3] ..... B22D 1/00; B22D 13/00

[52] U.S. Cl. ..... 164/133; 164/116

[58] Field of Search ..... 164/47, 114, 116, 122, 164/122.1, 133, 136, DIG. 6

[56] References Cited

U.S. PATENT DOCUMENTS

| | | | |
|---|---|---|---|
| 976,145 | 11/1910 | Brinell | 164/122 |
| 1,775,859 | 9/1930 | Multgren . | |
| 2,193,537 | 3/1940 | Nelson | 164/116 |
| 3,364,978 | 1/1968 | Tanoue et al. | 164/114 |
| 3,568,752 | 3/1971 | Williams | 164/47 |
| 3,614,976 | 10/1971 | Bolling et al. | 164/122 |
| 3,844,776 | 10/1974 | Bolling et al. | 164/114 X |

FOREIGN PATENT DOCUMENTS

| | | | |
|---|---|---|---|
| 39597 | 11/1971 | Japan | 164/122 |
| 7176 | 3/1973 | Japan | 164/116 |
| 459307 | 3/1975 | U.S.S.R. | 164/116 |
| 700280 | 11/1979 | U.S.S.R. | 164/47 |

OTHER PUBLICATIONS

*Interdendritic Fluid Flow and Macrosegregation; Influence of Gravity,* "Metallurgical Transactions", Mehrabian et al., vol. 1, p. 1209, May 1970.

*The Origin of Freckels in Unidirectionally Solidified Castings,* "Metallurgical Transactions", Copley et al., vol. 1, p. 2193, Aug. 1970.

*Macrosegregation in Casting Rotated and Oscillated During Solidification,* "Metallurgical Transactions", Stewart et al., vol. 2, p. 169, Jan. 1971.

*Fluid Motion Through the Partially Solid Regions of a Casting & Its Importance in Understanding A Type Seg.,* "Trans. of Met. AIME", McDonald et al., vol. 249, p. 1993, Sep. 1969.

*Macro Segration in Rotated Remelted Ingots,* Kou et al., "Metallurgical Transactions", vol. 9B, Dec. 1978, pp. 711–719.

*Primary Examiner*—Kuang Y. Lin

*Assistant Examiner*—Jerold L. Johnson

*Attorney, Agent, or Firm*—Michael, Best & Friedrich

[57] ABSTRACT

Macrosegregation in metal alloy castings and other alloys having similar solidification behavior is reduced by slowly rotating a mold or the like containing the liquid alloy about an axis at an acute angle to the vertical from the time the liquid alloy is poured into the mold until substantially all of the alloy has solidified. The mold is rotated at a speed below that which produces a centrifuging effect or causes stirring or agitation of the interdendritic liquid.

9 Claims, 2 Drawing Figures

METHOD FOR REDUCING MACROSEGREGATION IN ALLOYS

FIELD OF THE INVENTION

The invention relates to alloys and, more particularly, to methods for reducing macrosegregation during solidification of liquid alloys, such as metal alloy castings.

BACKGROUND OF THE INVENTION

As some molten metal alloys solidify after being poured into a container or mold, liquid inhomogeneities tend to develop in the partially solidified portion because of a difference in composition between the interdendritic liquid and the bulk liquid. In some alloys, particularly steels, the interdendritic liquid tends to become less dense than the bulk liquid, because of changes in temperature and composition, and tends to rise through the casting. In other alloys, the interdendritic liquid tends to become more dense than the bulk liquid and falls or sinks through the casting. In either case, as the interdentritic liquid percolates through the tree-like dendtritic system in the casting, local melting of previously solidified material leads to the development of larger channels through which large amounts of the less or more dense interdentritic liquids can rapidly flow. This condition not only can result in local inhomogenity, but, more importantly, can produce macrosegregation in the casting in the form of so-called "A" segregation in steel castings and severe localized "freckles" in electroslag (or vacuum arc) remelted ingots of steels and superalloys. This phenomena is discussed in more detail in R. Mehrabian et al, *Interdentritic Fluid Flow and Macrosegregation; Influence of Gravity,* Met. Trans., Vol. 1, 1209 (1970) and S.M. Copley et al, *The Origin of Freckles in Unidirectionally Soldified Casting,* Met. Trans. Vol. 1, 2193 (1970).

This type of macrosegregation occurs in ingots or castings having relative low rates of solidification and is more prevalent in large castings, for example, 10 ton castings of medium to high carbon steels. Under severe macrosegregation conditions, the carbon content in medium carbon steel ingots can vary from more than 1% in the top portion to less than 0.5% in the bottom portion. For applications where this variation in the composition is unacceptable, it is necessary to physically remove relatively large portions of the ingot, a costly and time consuming procedure. Some reduction in macrosegregation can be obtained by using a suitable combination of solutes which minimize density variations and thereby retard the development of segregation channels. However, such an approach ordinarily is effective only over limited composition ranges and the choices of solutes for this purpose may not be compatible with the specifications for the alloy.

It is known that the grain structure of a metal casting can be refined by agitating the casting mold during solidification, such as rotating or oscillating the mold in various manners. Examples of such methods are disclosed in U.S. Pat. Nos. 1,775,859 (Hultgren), 3,568,752 (Williams) and 3,614,976 (Bolling et al.), Japanese Patent No. 71/39597 and M. Stewart et al, *Macrosegregation in Castings Rotated and Oscillated During Solidification,* Met. Trans. Vol. 2, 169 (1971). In these methods the mold is rotated about a vertical axis or a horizontal axis, the mold is rotated in a manner to agitate or stir the bulk liquid, and/or the mold is not rotated during the entire period of solidification.

S. Kou et al., *Macrosegregation in Rotated Remelted Ingots,* Met. Trans. B. Vol. 9B, 711 (1978) discloses the use of centrifugal force, by rotating the mold about a vertical axis at a speed in the order of 76 rpm during solidification of the ingot, to reduce radial or horizontal macrosegregation.

Applicant is unaware of any prior publications disclosing the concept of rotating a mold or container about an axis inclined to the vertical at speeds substantially below those which produce centrifuging.

SUMMARY OF THE INVENTION

A principal object of the invention is to provide a method for reducing macrosegregation in a wide variety of alloys.

Another object of the invention is to provide an inexpensive, effective method for casting molten metal alloys having reduced macrosegregation.

A further object of the invention is to provide an inexpensive method for casting molten metal alloys having reduced macrosegregation without the use of additives.

A still further object of the invention is to provide a method for reducing macrosegregation in alloys by retarding the development of segregation channels therein during solidification.

Other objects, aspects and advantages of the invention will become apparent to those skilled in the art upon reviewing the following description, the drawing and the appended claims.

In accordance with the invention, macrosegregation in liquid alloys which exhibit a change in density with change in composition and temperature during solidification and have a solidification time sufficiently long for segregation channels to form in the partially solidified portion (if allowed to solidify in a stationary container) is reduced by slowly rotating a mold or the like containing the alloy about at axis at an angle to the vertical of about 10° to about 50° until substantially all the alloy has solidified. This rotation about an inclined axis continuously changes the direction of gravitational force on the interdentritic liquid and thereby apparently retards the formation of segregation channels in the partially solidified portion, particularly generally vertical segregation channels.

The speed of rotation is below that which produces a centrifuging effect or causes substantial stirring or agitation of the interdentritic liquid.

DESCRIPTION OF PREFERRED EMBODIMENTS

The method of the invention is applicable generally to liquid alloy systems in which the interdentritic liquid exhibits a change in density with changes in composition and temperature during solidification and which have a solidification times sufficiently long for segregation channels to form in the partially solidified portion, as described above, if allowed to solidify in a stationary container. The method is particularly useful for casting large steel ingots such as medium to high carbon steels containing approximately 0.5 to 1.5 weight % or more carbon and will be described for that application.

Figure 1:
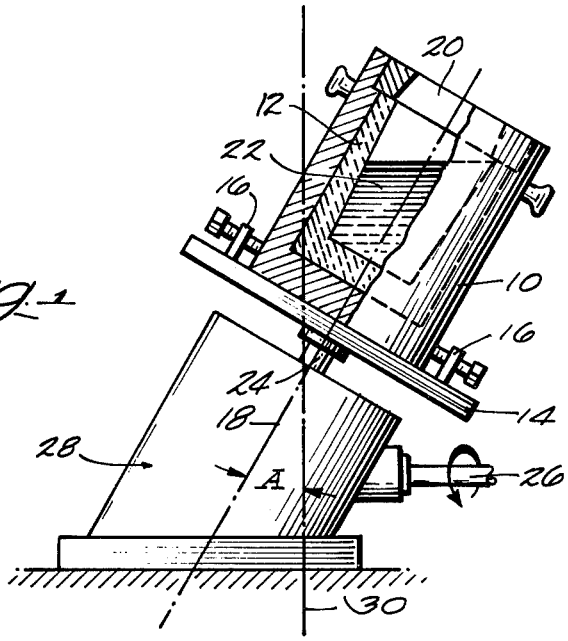
FIG. 1 is a schematic representation of apparatus suitable for practicing the invention.

Schematically illustrated in FIG. 1 is suitable apparatus for practicing the method of the invention. The molding container or vessel 10, which can be made from steel and lined with a suitable refractory material 12 (e.g., molding sand or a ceramic type material), is supported on a turntable 14. The molding vessel 10 is suitably secured to the turntable 14, by clamps 16 or the like, for common rotation therewith. The molding vessel 10 preferably is coaxial with the turntable 14 as illustrated and is revolved about the rotational axis 18 of the turntable 14. If desired, the molding vessel 10 can be located off center of the turntable 14 so that the molding vessel is rotated eccentrically. While the molding vessel 10 can be open at the top, the illustrated embodiment includes a cover 20 which is installed after the molten steel 22 is poured into the molding vessel 10. In actual practice, it may be more desirable for the top portion of the molding vessel to be necked down to reduce slop of liquid around the walls during rotation.

The turntable 14 is mounted on a shaft 24 which is driven by a driveshaft 26 connected to a suitable power source (not shown) and drivingly connected to the turntable 14 through a suitable gear box assembly generally designated by reference numeral 28. The power source is a variable speed type so that the rotational speed of the turntable 14 can be adjusted to provide a desired predetermined rate of rotation of the molding vessel 10.

The gear box assembly 28 is arranged so that the turntable 14, and thus the molding vessel 10, is rotated about an axis at an incline to the vertical. That is, the rotational axis 18 of the turntable 14 and the molding vessel 10 is located at an acute angle "A" to the vertical represented by reference numeral 30.

The molding vessel 10 is rotated from the time the molten steel 22 is poured therein until substantially all the steel has solidified. This time period will vary depending upon composition of the alloy, the pouring temperature, the dimensions (particularly the height and width) and geometry of the casting, and the temperature and heat transfer characteristics of the molding vessel 10. Generally, this time period can range from about 20 minutes up to 24 hours or more.

While not completely understood at this time, it is believed that the continuous change in the direction of gravitational force on the droplets of interdentritic liquid, as the molding vessel is slowly rotated about an inclined axis, inhibits the vertical flow or movement (either upwardly or downwardly) of the interdentritic liquid which can produce well defined segregation channels as described above. That is, the droplets of interdentritic liquid experience a continuous changing direction of flow around the surface of a cone having a semi-apical angle equal to angle "A". It is been found that a similar reduction in the formation of segregation channels, and thus macrosegregation resulting therefrom, does not occur when a mold is slowly rotated about a vertical axis.

The angle of inclination (angle "A") is that sufficient to inhibit vertical flow of the interdentritic liquid. Generally, the angle of inclination is about 10° to 50°, preferably about 20° to about 40°. At present, an angle of inclination of about 30° is most preferred.

The molding vessel 10 is rotated at a speed which is sufficient to inhibit vertical movement of the droplets of interdendritic liquid without producing a centrifuging effect. The speed will vary depending primarily on the angle of inclination, composition of the alloy, and the dimensions and geometry of the casting. A rotational speed up to about 10 revolutions per minute ordinarily is sufficient for this purpose. Speeds higher than about 10 revolutions per minute can be used for some alloys, but can create an undesirable centrifuging effect with others. At present, a rotational speed of about 1 to about 5 revolutions per minute is preferred.

Primarily because less complex apparatus is required, the desired change in the direction of gravitational force on the droplets of the interdendritic liquid is obtained by slowly rotating the mold in one direction about an inclined axis, either coincidentially with or offset from the longitudinal axis 18 of the molding vessel 10. However, the same effect can be obtained by oscillating or rocking the molding vessel about an inclined axis at a speed which does not produce an undesired centrifuging effect. Continuous rotation about the longitudinal axis generally is more desirable for symmetrical cylindrical molding vessels. On the other hand, a rocking or oscillating movement may be more desirable for unsymmetrical molding vessels, particularly those having a thin, rectangular cross section.

Without further elaboration, it is believed that one skilled in the art can, using the preceding description, utilize the present invention to its fullest extent. The following examples are presented to exemplify the invention and should not be construed as limitations thereof.

In all the examples, ammonium chloride-water solutions were used. Such solutions are recognized as an analogue for plain carbon steels in which the interdendritic liquid is richer in carbon than the bulk liquid and also less dense. Reference is made to R. J. MacDonald et al, *Fluid Motion Through the Partially Solid Regions of a Casting and Its Importance in Understanding A Type Segregation,* Trans. Mat. Soc. AIME Vol. 245, 1993 (1969) and the above-identified article by S. M. Copley et. for a discussion of the parallel between the behavior of such solutions and steel castings. One important difference is that the proportion of solid growing from the aqueous solution during cooling is smaller than that in a molten metal alloy which eventually solidifies completely. This means that the volume fraction of the interdendritic liquid in ammonium chloride-water solutions is larger and the partially solidified mixture is much more open and permeable than in metal alloys. As a result, fluid flow in the liquid-solid mixture is much more rapid than in actual metal castings and segregation channels develop much more easily. Therefore, it is reasonable to believe that a method found to be effective in inhibiting the formation of segregation channels in an ammonium chloride-water analogue should be at least as effective for metal alloys and most likely more effective.

In all the tests, an aqueous solution saturated with ammonium chloride at a temperature of 50° C. was used. The solution was poured into two types molds, one having a chilled copper surface on one side and the other having a chilled copper base. The copper side of the side-chilled mold was cooled with solid carbon dioxide in methanol at −76° C. and the solution was poured at 65° C. The copper base of the base-chilled mold was cooled with liquid nitrogen at −196° C. and the solution was poured at 85° C. Ammonium chloride crystals precipitated on the chilled surface and grew outwardly (side chilled mold) or upwardly (base chilled mold) into the bulk of the solution. The interdendritic liquid trapped between ammonium chloride crystals, being less concentrated (i.e., richer in water) than the bulk liquid and, thus, less dense, tended to rise upwardly toward the top of the mold. Crystal growth was recorded photographically. Bulk liquid samples were extracted with a pipette at various locations and times. These samples were analyzed by determining the freezing point and referring to a published phase diagram.

EXAMPLE 1

In one test series, a small slab mold (approximately 6 in. wide and 12 in. high) having a copper bar on one edge and a transparent panel forming one side was used to simulate a section through an ingot which has a circular or square cross section and in which solidification proceeds inwardly from the sides. The copper bar extended into a flask containing solid carbon dioxide in methanol at −76° C.

After the ammonium chloride-water solution was poured into the mold, the crystal growth pattern was observed through the transparent panel as the ammonium chloride precipitated. Also, samples of the liquid were taken at 2 minute intervals with a pipette inserted about 1 cm. below the top surface of the liquid and analyzed for ammonium chloride concentration.

Four different test conditions were used: (1) mold vertical and stationary, (2) mold rotated at 5 rpm about a vertical axis, (3) mold rotated at 1 rpm about an axis at 30° to the vertical and, (4) mold rotated at 5 rpm about an axis at 30° to the vertical.

Under condition (1), "A" type segregation channels began to appear after about 5 minutes. After a period of about 10 minutes, the bulk liquid became quiescent except for plumes or streams of water-rich liquid rising from the ends of the segregation channels. After 30–40 minutes when columar crystal growth effectively ceased, the bulk liquid became stratified in the upper regions. The results were quite similar under condition (2).

Under conditions (3) and (4) the development of segregation channels was slower than under conditions (1) and (2) and, when segregation channels did form, they appeared to be more diffuse. Also, the rate of dilution of the liquid of the top portion of the mold was considerably slower.

Figure 2:
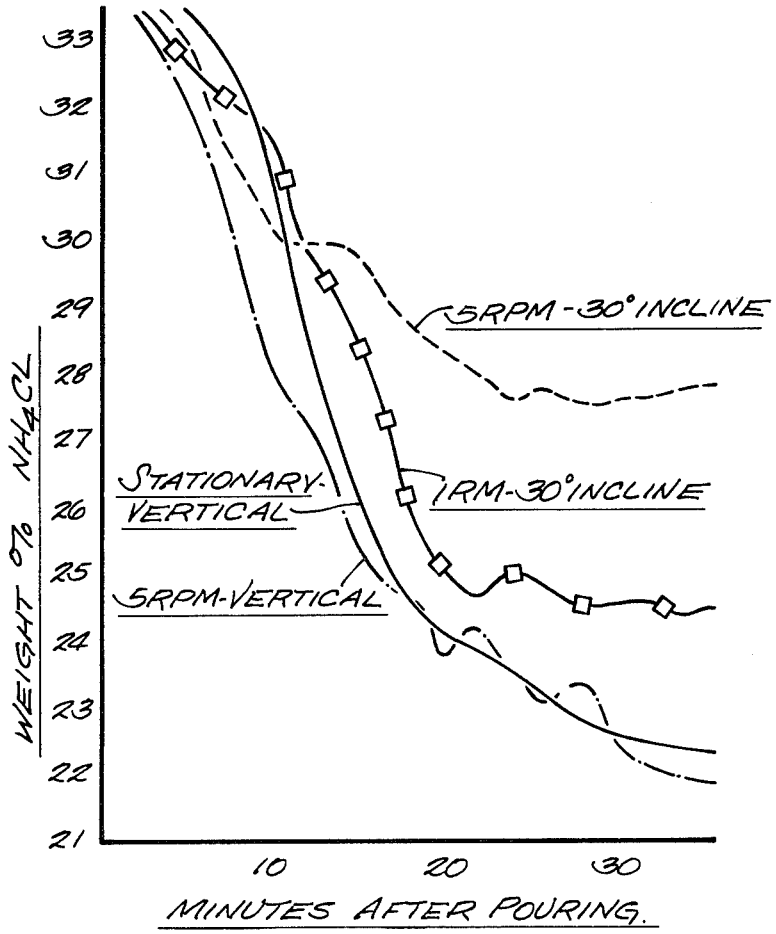
FIG. 2 is a graph of test data from Example 1 showing changes in the composition of liquid in the top portion of a mold as a function of time with the mold stationary and rotated at different speeds about vertical and inclined axes.

The change in the composition of the liquid in the top portion of the mold under these four conditions is graphically illustrated in FIG. 2.

EXAMPLE 2

In another test series, a cylindrical mold, consisting of transparent tubing mounted on a copper base cooled with liquid nitrogen, was used to simulate vertical crystal growth pattern of electroslag or arc remelted ingots of steel and superalloys. The following test conditions were used: (1) mold vertical and stationary, (2) mold rotated at 5 and 10 rpm about a vertical axis, (3) mold inclined at an angle of 30° to vertical and stationary, (4) mold rotated at 1, 2.5, 5 and 10 rpm about an axis inclined at an angle of 30° to the vertical and (5) mold rotated at 5 rpm, about axes of 10° and 20° to the vertical.

Under condition (1) freckles appeared across the dendritic growth front after about 10–15 minutes and plumes of less dense liquid rose vertically toward the top of the mold. Convection currents in the bulk liquid eventually mixed the dilute liquid so that it did not accumulate at the top as in the tests described in Example 1.

Under condition (2), at both 5 and 10 rpm, the development and distribution of freckles was not significantly different from condition (1).

Under condition (3) "freckles" appeared on one (upper) side of the crystal growth as segregation channels developed vertically from the chilled base.

Under condition (4), at 1 rpm, a few freckles appeared toward the middle of the crystal growth front after about 30 minutes. At 2.5 rpm, no distinct freckles appeared, except for some irregularity at the center after about 1 hour. At 5 rpm, there was no sign of freckles and no distinguishable plumes of less dense liquid. At 10 rpm, the crystal growth front became markedly concave toward the middle of the liquid, apparently due, at least in part, to centrifugal force. Fine channels appeared at the mold walls after about 45 minutes.

Under condition (5), at 20° inclination, no distinct freckles appeared after one hour and no distinct plumes of solute-enriched liquid could be distinguished. At 10° inclination, freckle development was not perceptible until about 45 minutes. The freckles which developed thereafter were evenly distributed and very fine.

EXAMPLE 3

In another series of tests with the mold described in Example 2, the solution was poured into the mold with the mold stationary and vertical and crystals were allowed to grow for approximately 30 minutes to develop 4 or more well defined freckle channels and associated solute plumes. The mold was then tilted 30° to the vertical and rotated at 5 rpm. The solute plumes disappeared almost immediately and the freckles were no longer discernible after about 5 minutes. After one hour, rotation was stopped and plumes and freckles reappeared within 2–3 minutes at positions different from the first time.

From these test results, it can be seen that slowly rotating the mold about an inclined axis, at a speed below which a centrifuging effect is produced, causes a distinct reduction in the rate of formation of segregation channels and a resultant macrosegregation. On the other hand, little or no reduction in the rate of the formation of segregation channels is obtained by rotating the mold at the same speed about a vertical axis or by inclining the mold and keeping it stationary. Furthermore, the test results in Example 3 indicate that the rotational movement should be continuous until substantially all the alloy is solidified in order to retard the formation of segregation channels.

From the foregoing description, one skilled in the art can easily ascertain the essential characteristics of the invention and, without departing from the spirit scope thereof, make various changes and modifications to adapt it to various usages.

I claim:

1. A method for reducing macrosegregation in a solidified alloy which exhibits a change in density with changes in composition and temperature during solidification and has a solidification time sufficiently long for segregation channels to form in the partially solidified portion if allowed to solidify in a stationary container, said method comprising the steps of:

pouring the alloy as a liquid into a container having a longitudinal axis, and slowly rotating the container at a speed which does not produce a centrifuging effect about said axis, with said axis at an angle to the vertical of about 10° to about 50°, from the time the liquid alloy is poured into the container until substantially all of the alloy has solidified, so as to continuously change the direction of gravitational force on the interdendritic liquid and thereby retard the formation of segregation channels in the partially solid portion.

2. A method according to claim 1 wherein said alloy is a molten metal.

3. A method according to claim 2 wherein the mold is rotated up to about 10 revolutions per minute.

4. A method according to claim 3 wherein the mold is rotated at about 1 to about 5 revolutions per minute.

5. A method according to claim 1 wherein the mold is rotated in the same direction for the entire time.

6. A method according to claim 1 wherein the mold is rotatably oscillated about said axis.

7. A method according to claim 1 wherein said angle is about 20° to 40°.

8. A method according to claim 6 wherein said angle is about 30°.

9. A method according to claim 2 wherein said molten metal is a steel of medium to high carbon content.

* * * * *